United States Patent [19]

Sharma

[11] Patent Number: 4,568,893

[45] Date of Patent: Feb. 4, 1986

[54] MILLIMETER WAVE FIN-LINE REFLECTION PHASE SHIFTER

[75] Inventor: Arvind K. Sharma, Cranbury, N.J.

[73] Assignee: RCA Corporation, Princeton, N.J.

[21] Appl. No.: 696,748

[22] Filed: Jan. 31, 1985

[51] Int. Cl.[4] ..... H01P 1/18; H01P 1/185

[52] U.S. Cl. ..... 333/157; 333/161; 333/164; 333/248

[58] Field of Search ..... 333/157, 161, 164, 245, 333/246, 248, 258, 262, 120–122, 138–140; 332/16 R, 17, 29 R, 30 R, 30 V

[56] References Cited

U.S. PATENT DOCUMENTS

| | | | |
|---|---|---|---|
| 2,907,959 | 10/1959 | Robertson | 333/115 X |
| 3,436,691 | 4/1969 | Hoffman | 333/164 |
| 3,715,692 | 2/1973 | Reuss, Jr. | 333/156 X |
| 3,882,431 | 5/1975 | Hopwood et al. | 333/139 |
| 3,914,713 | 10/1975 | Koniski et al. | 333/110 X |
| 4,105,959 | 8/1978 | Stachejko | 333/161 |
| 4,254,383 | 3/1981 | Wolfe | 333/161 |

OTHER PUBLICATIONS

"Wideband Branchline Couplers in Fin-Line Technology", by H. El Hennawy et al., Archiv fur Elektronik und Ubertragungstechnik, (AEU), vol. 37, Jan.-Feb. 1983, pp. 40–46.

"New Millimeter-Wave Fin Line Attenuator and Switches", H. Meinel et al., IEEE MTT-s, International Microwave Symposium, 1979.

"Broad-Band Diode Phase Shifters", R. V. Garver, IEEE Transactions on Microwave Theory and Techniques, vol. MTT-20, No. 5, May 1972, pp. 314–323.

"The Status of Printed Millimeter-Wave E-Plane Circuits", K. Solvach, IEEE Trans. Microwave Theory and Techniques, vol. MTT-31, pp. 107–121.

"Hybrid Branch Line Coupler—A Useful New Class of Directional Couplers", B. Schiek, IEEE Trans. Microwave Theory and Techniques, vol. MTT-22, pp. 864–869.

"Octave Band Fin Line Hybrid", H. El Hennawy et al., 11th European Microwave Conference, 1981.

*Primary Examiner*—Marvin L. Nussbaum

*Attorney, Agent, or Firm*—Joseph S. Tripoli; Robert L. Troike; Robert Ochis

[57] ABSTRACT

A millimeter wave reflection phase shifter employs a fin-line structure within a waveguide network which has a central leg and four arms which together form two symmetric Y-junctions. The fin-line forms a septum within the waveguide and includes a conductive layer having a central gap or slot therein which extends along the leg and into each of the arms. Means for shorting the slot arms disposed at one end of the leg controls the phase shift experienced by a signal propagating through the phase shifter. This phase shifter may provide multiple selectable phase shifts.

11 Claims, 5 Drawing Figures

MILLIMETER WAVE FIN-LINE REFLECTION PHASE SHIFTER

The government has rights in this invention pursuant to Contract No. F19628-83-C-0073 awarded by the Department of the Air Force.

BACKGROUND OF THE INVENTION

The present invention relates to radio frequency phase shifters and more particularly to such phase shifters for millimeter wavelength signals.

A technology which has been found useful in the millimeter wave frequency range (30 GHz to 300 GHz) is known as fin-line. A fin-line structure comprises a rectangular waveguide having a dielectric substrate therein oriented parallel to the E-plane of the waveguide and extending between the waveguide's lateral walls. The E-field of a fundamental mode wave within a waveguide is parallel to the E-plane.

A conductive layer comprising one or more separate conductive members is disposed on the dielectric substrate. Generally each conductive member is in electrical contact with at least one lateral wall. Since the conductive layer is in contact with the lateral wall it behaves electrically as a ridge or fin within the waveguide.

Radio frequency radar and communication systems which operate in the millimeter wave frequency range are desired. A number of different components needed for the construction of such millimeter wave systems operating at up to about 100 GHz are presently being developed. Many such systems will require compact, propagation control devices such as electrically controllable phase shifters having low loss and low phase variation over a substantial operating frequency band.

SUMMARY OF THE INVENTION

The present invention provides such a phase shifter in the form of a waveguide network having a fin-line structure therein and including a leg section and first through fourth arm sections. The first and second arm sections are connected to one end of the leg section to form a first Y-junction. The third and fourth arm sections are connected to the other end of the leg section to form a second Y-junction. The fin-line structure disposed within the waveguide network includes a dielectric substrate disposed parallel to the E-plane of the waveguide. The substrate has a layer of conductive material disposed on a first major surface thereof. A central slot or gap in this conductive material extends along the leg section and portions of each of the four arm sections. The first and second arm sections provide first and second ports for connecting signals to the phase shifter while the third and fourth arm sections include means for providing a short circuit across the slot within those arms sections to control signal propagation between the first and second ports. Where selectable phase shifts are desired, switches such as PIN diodes are connected across the slot to selectively impose a short circuit across the slot in order to change the effective length of the slot and thereby control the phase shift experienced by a signal transmitted between the first and second ports. Inclusion of multiple switches in each of the third and fourth arms enables multiple phase shifts to be provided by the single structure.

DETAILED DESCRIPTION OF PREFERRED EMBODIMENT

Figure 1:
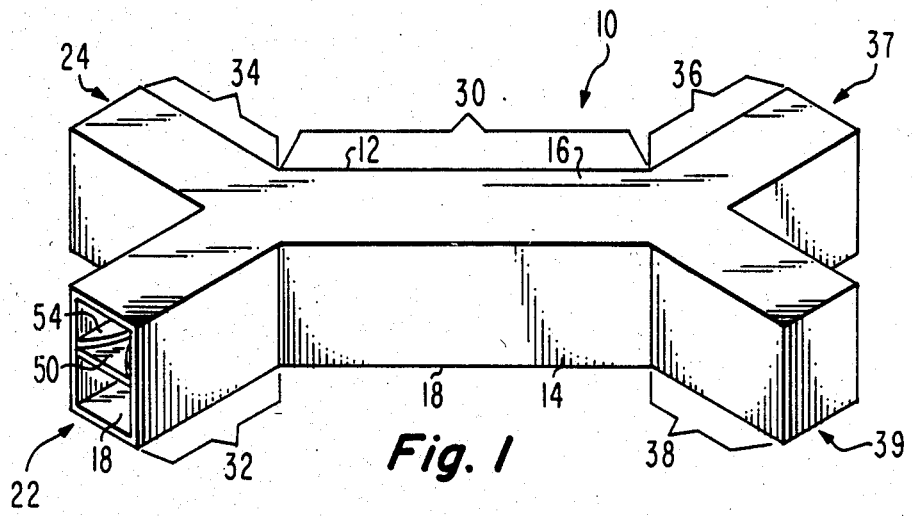
FIG. 1 is a perspective view of a waveguide structure in accordance with the present invention.

In FIG. 1 a millimeter wave phase shifter 10 in accordance with the present invention is illustrated. The phase shifter 10 comprises a waveguide network 12 having a top wall 16, a bottom wall 18 and lateral walls 14 extending therebetween. The waveguide network 12 has a leg section 30 to which a first arm section 32 and a second arm section 34 connect at one end and to which a third arm section 36 and a fourth arm section 38 connect at the other end. The arm sections 32 and 34 along with the leg section 30 form a first Y-junction. The arm sections 36 and 38 along with the leg section 30 form a second Y-junction. The two arms and the leg end which form either of the Y-junctions are disposed with their longitudinal axes mutually spaced at angles of 120 degrees to each other in order to provide a symmetrical Y-junction. The free ends of the arm sections 32 and 34 (which are remote from the leg section 30) comprise ports 22 and 24 for coupling of signals into the phase shifter 10 and hereafter the arm sections 32 and 34 may be referred to as the port arm sections. The ports 22 and 24 are shown open in FIG. 1 but in a system they will be connected into the transmission path of the signal to be phase shifted. The terminating end 37 of arm section 36 which is remote from leg section 30 and the terminating end 39 of the arm section 38 which is remote from the leg section 30 are both closed with a conductive plate covering in a short circuiting manner across the waveguide. Hereafter these arm sections 36 and 38 may be referred to as propagation or phase control arm sections.

Figure 2:
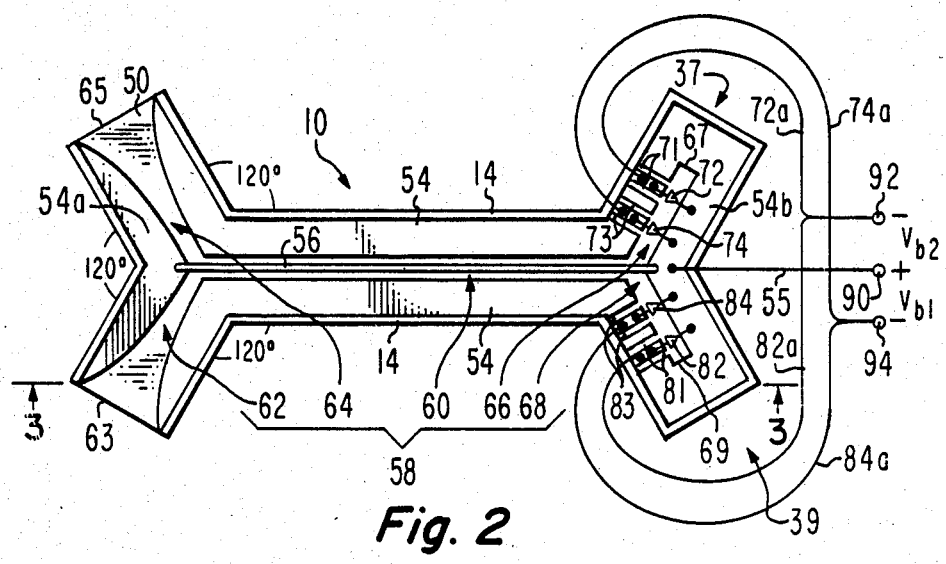
FIG. 2 is a top plan view of the structure in FIG. 1 with the top wall removed.
Figure 3:
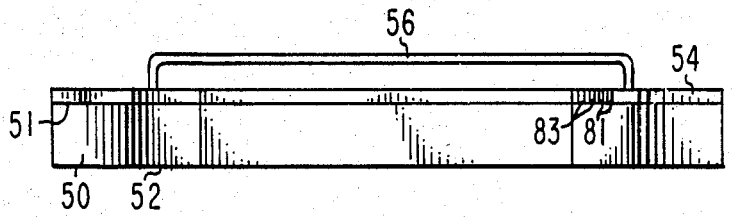
FIG. 3 is an elevation view of the fin-line structure only looking in a direction of the arrow 3 in FIG. 1.

A septum in the form of a thin dielectric substrate 50 within the waveguide 12 is centered between the top wall 16 and bottom wall 18 and oriented with its major surfaces parallel to those walls. See FIGS. 1, 2 and 3. The substrate 50 extends across the entire width of the waveguide 12 from lateral wall to opposite lateral wall to divide the waveguide 12 into two equal halves. On the upper surface 51 (FIG. 3) of the substrate 50 is disposed a conductive layer 54 having a central non-conductive gap 58 therein. This central gap or non-conductive portion is referred to hereinafter as a slot because the conductive layer 54 with the gap therein behaves as a slot waveguide for millimeter wave signals propagating in the waveguide network. The slot 58 extends along the leg section 30 where it is termed leg 60, extends along arm section 32 where it is termed a first (port) arm 62, extends along arm section 34 where it is termed a second (port) arm 64, extends along the arm section 36 where it is termed a third (phase control) arm 66 and extends along the arm section 38 where it is termed a fourth (phase control) arm 68.

In this embodiment, the conductive layer 54 bounds the slot 58 on all sides except at the ends 63 and 65 of the port arms 62 and 64, respectively, which are located at the ports 22 and 24 of the phase shifter. See FIG. 2. The slot ends 63 and 65 are the ends of their respective arms which are remote from the leg 60. Each portion of the slot 58 is disposed in a corresponding portion of the waveguide network 12 and is laterally centered within that corresponding waveguide section whereby the length of each portion of the fin-line slot is parallel to and centered about the longitudinal centerline or axis of the corresponding waveguide section. In this embodiment, the conductive layer 54 short circuits the slot arms 66 and 68 at prescribed distances from the leg 60 to form ends 67 and 69, respectively, of the slot arms 66 and 68. The leg 60 is one quarter wavelength long in the operating frequency range of the phase shifter in order to provide the network in the vicinity of the leg with the characteristics of a 3 db hybrid. The conductive layer 54 extends to the lateral walls 14 of the waveguide network and is electrically connected thereto at least within the operating frequency range of the phase shifter.

Two switches 72 and 74 are connected across the slot arm 66 at prescribed distances from the leg 60. The switches 72 and 74 are preferably PIN diodes. Similar switches 82 and 84 are connected across the slot arm 68 the same distances from the leg 60. In order to separately DC bias the PIN diodes 72, 74, 82 and 84, the conductor 54 has small thin isolating gaps 71, 73, 81 and 83 on either side of the diode connections. These gaps extend from the slots 66 or 68 toward the lateral walls. The conductor 54 in this region between these gaps does not extend to the lateral walls to also provide the DC isolation from the lateral walls 14. The gaps are made small so that at the operating frequency of this phase shifter the conductor 54 remains effectively continuous across the gaps 71, 73, 81 and 83 and the gaps between the slots 66 and 68 and the lateral walls because of capacitive coupling across those gaps. The anodes of the diodes 72 and 82 are connected to a first control terminal 92 by conductive leads **72*a* and 82*a* attached to the DC isolated portions of the conductor 54 to which those anodes are attached. The anodes of the diodes 74 and 84 are similarly connected by leads 74*a* and 84*a* to a control terminal 94. The portion 54*b* of the conductor 54 to which the cathodes of the diodes 72, 74, 82 and 84 attach is connected to a control terminal 90 by another lead 55**.

The state of the diodes 72 and 82 is controlled by the voltage $V_{b1}$ applied across the terminal pair 90, 92 and the state of the diodes 74 and 84 is controlled by the voltage $V_{b2}$ applied across the terminal pair 90, 94. Thus, the operation of the diodes is geometrically identical in both phase control arms. When a diode is in its on state (forward biased) it imposes a radio frequency (RF) short across the slot legs 66 or 68 at its location.

Within the leg section 30 of the waveguide a wire 56 is disposed above the substrate 50 in alignment with the leg 60 portion of the fin-line slot 58. This wire is connected to the portions **54*a* and 54*b* of the conductive layer 54 which are located respectively between the slot arms 62 and 64 and 66 and 68. In combination, the slot 58 and the wire 56 serve to form a 3 dB hybrid connecting the four arms of the fin-line structure. The configuration of the substrate 50, the conductive layer 54 and the wire 56** is illustrated in a side elevation view in FIG. 3. Hybrids of this type are discussed in greater detail in articles entitled "Wideband Branchline Couplers in Fin-Line Technology" by H. El Hennawy, et al Archiv fur elektronik und ubertragungstechnik, (AEU) Vol. 37, January–February, 1983, pp 40–46, and "Octave band fin line hybrid" by H. El Hennawy, et al, 11th European Microwave Conference, 1981 pp 301–304.

The conductive layer 54 tapers away from the centerlines of the slot portions 62 and 64 as the distance from the leg 60 increases, i.e. the gap widens. This is to provide smooth transition between the system impedance at the ports 22 and 24 and the impedance of the fin-line structure remote from those ports. This taper is unnecessary if the ports 22 and 24 connect to fin-line structures containing similar slots.

In operation, a signal entering the arm 62 at port 22 propagates along the slot arm 62, down the slot leg 60 and divides evenly between the phase control slot arms 66 and 68. The signals in the arms 66 and 68 are 90 degrees out-of-phase because of the 3 dB hybrid formed by this slot structure. With the diodes 72, 74, 82 and 84 off or nonconducting, the signal propagates to the shorted end of each of the phase control slot arms, is reflected there, propagates back along that slot arm to the slot leg 60, along the slot leg and emerges from the structure along the slot arm 64. No return signal merges along the arm 62 of the slot because of the phase conversion effects of the Y-junctions and the presence of the wire 56 which cause the structure to function as a 3 dB hybrid. In practice the diodes may be held off by applying negative voltages from terminal 92 to terminal 90 and from terminal 94 to terminal 90. Alternatively, making the voltages across these terminal pairs zero volts will hold the diodes off.

If it is desired to change the phase shift experienced by the signal propagating from port 22 through the structure to port 24 by a first amount, then the switches 72 and 82 are closed by applying a positive voltage $V_{b1}$ from terminal 92 to terminal 90 to forward bias (turn on) the diodes 72 and 82 to provide an RF short circuit across the slot at the location of the on diode. The RF short across the arms which reflects the signals which enter the arms 66 and 68 from the leg 60 are thereby moved to the locations of the diodes 72 and 82. This reduces the overall length of the path along which the wave propagates by twice the distance from either diode to the shorted end of its slot, since with these diodes off, the signal propagated past them to the shorted end of the slot, was reflected there and then propagated back to the diode. With the diode on, this round trip path length is removed from the signal path and the phase of the signal emerging at port 24 is shifted a corresponding amount. Since the switches 72 and 82 are at the same distance from the shorted end 67 and 69, respectively, of their slot arms, the phase of the two reflected signals relative to each other does not change and the 3 dB hybrid effect causes the entire emergent signal to propagate only along the slot arm 64. A greater change in phase shift is produced by closing the switches 74 and 84 which are further from the short circuited ends 67 and 69 of the slot arms 66 and 68.

In this configuration, the phase shifter exhibits broadband behavior with operation over an octave bandwidth being possible within the frequency range up to about 75 GHz. When the diodes are in the off state they cause some insertion loss which depends on their particular parameters in the off state. This insertion loss increases substantially above 75 GHz. Because of the problem of excessive insertion loss in the PIN diodes above 75 GHz in the off state, which is due to parasitics present in the commercially available diodes, the phase shifter configuration 10 is not feasible for use above about 75 GHz. The insertion loss problems with presently available commercial PIN diodes in the above 75 GHz frequency range are a combination of junction capacitance, lead inductance and series resistance. As better diodes are developed, it will be possible to use the phase shifter 10 configuration at higher frequencies when broadband operation is desired.

If desired, the wire 56 may be replaced by a strip conductor disposed on the undersurface 52 of substrate 50 in alignment with the slot leg 60. For operation at millimeter wave frequencies up to about 40 GHz, the waveguide 12 is preferably 0.34 inch (0.86 cm) high by 0.17 inch (0.43 cm) wide. The dielectric substrate 50 is 10 mils (0.010 inch or 0.025 cm) thick and has a dielectric constant of 2.22. RT-duroid available from Rogers Corporation of Chandler, Ariz., is an appropriate material for this substrate. The leg section 60 of the slot 58 is 2.7 mm long while the length of the slot arms 66 and 68 is selected in accordance with the phase shift which is desired. The width of slot 58 except near the port ends is 0.2 mm for this unilateral (one-sided) fin-line. This results in a characteristic impedance $Z_o$ of 160 ohms. This results in the 3 dB hybrid having a 0.5 dB insertion loss and providing 20 dB of isolation.

If a number of these phase shifters are to be produced, it may be preferred to replace the wire 56 with a strip conductor on the underside 51 of the substrate in order to minimize variations among the different phase shifters. Such a strip should have the same width as the slot 58 and be 2.84 mm long.

Figure 4:
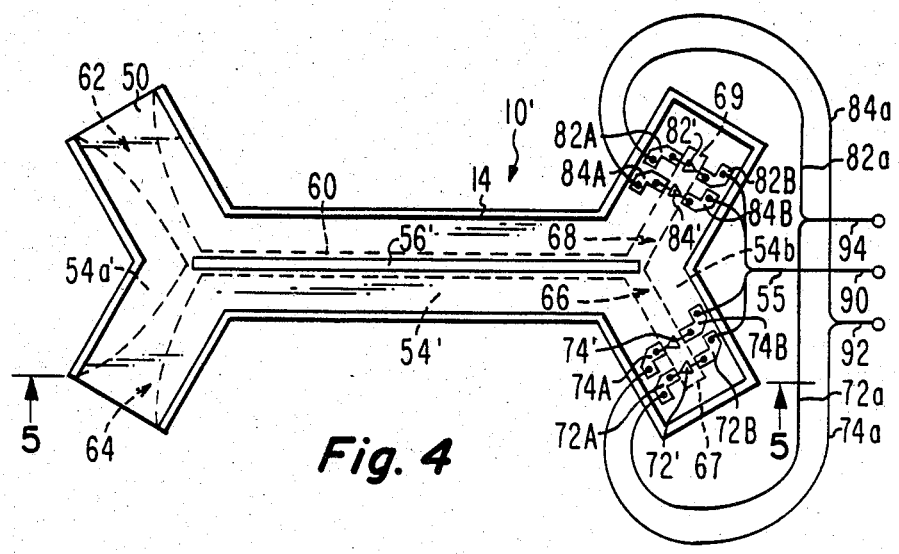
FIG. 4 is a view like that in FIG. 2, but of a modified version of the structure.
Figure 5:
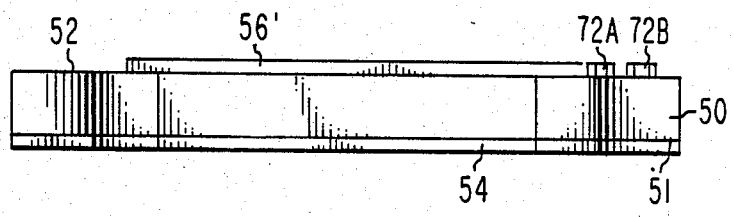
FIG. 5 is an elevation view of the fin-line structure in FIG. 4 taken along the direction of arrow 5 of FIG. 4.

An alternative embodiment 10' of the phase shifter 10 is illustrated in FIGS. 4 and 5. The view in FIG. 4 is of the surface 52 of substrate 50. The phase shifter 10' is like the phase shifter 10 except for the configuration of its switches 72', 74', 82' and 84' and the resulting change in the configuration of the conductive layer 54' and the replacement of wire 56 by a conductive strip 56' disposed on the lower surface of the substrate. The remainder of the elements of the phase shifter are the same in phase shifters 10 and 10' and retain their same reference numerals in FIGS. 4 and 5 as they have in FIGS. 2 and 3. Phase shifter 10' is a reconfigured version of phase shifter 10 which can be operable to a frequency of about 100 GHz. In phase shifter 10', the diodes 72', 74', 82' and 84' are mounted on the second or non-conductive side 52 of the substrate 50. Each of these diodes connects two microstrip resonator plates which are disposed on the surface 52 of the substrate 50. These plates are referred to by the reference numerals 72A and 72B, 74A and 74B, 82A and 82B and 84A and 84B. The plates 72A and 72B, are configured so that when the diode 72 which connects them is forward biased, a half-wave resonator is provided at the desired operating frequency of the phase shifter. This resonator comprises two open circuit microstrip transmission lines, each composed of a plate 72A or 72B, the substrate and the conductive layer 54 on side 51 of substrate 50. The plates 72A, 72B, 74A, 74B, 82A, 82B, 84A and 84B each preferably have a width of less than half a wavelength in the dielectric at the desired operating frequency. This restricts the propagating signal to the fundamental mode in these microstrip lines. These plates (72A and 72B) are bent in the FIG. 4 embodiment in order to fit their required length within the waveguide. The exact configuration for these plates is best determined experimentally for a given diode type and operating frequency. With the diode on, the resonator has a lumped element equivalent circuit in the form of a series RLC circuit. The resonant frequency $\omega$is $\sqrt{1/LC}$ For a given desired operating frequency, $\omega$ is known, L can be approximated from the diode's characteristics and the inductance of bonding wires. With values known for $\omega$ and L, the value of C can be calculated. This value is provided by choosing the width and length of the plates 72A and 72B to provide a desired characteristic impedance ($Z_o$) and input impedance ($Z_s$) for the transmission line formed by the plate 72A or 72B, the substrate and the layer 54. The input impedance $Z_s$is $-j\ Z_o \cot \beta l$ for an open circuited line having a length which is an integer number of full wavelengths plus less than one quarter wavelength. $\beta l$ is the phase length of the line.

The structure of the resonator is fabricated using the determined dimensions. The actual resonant frequency of this structure with the diode on is determined. If different from the desired frequency, the frequency is adjusted by changing the length of the plate. The plate is shortened to raise the resonant frequency or lengthened to reduce the resonant frequency. Switches of this type are described in greater detail in an article entitled, "NEW MILLIMETER-WAVE FIN-LINE ATTENUATORS AND SWITCHES" by H. Meinel, et al. *IEEE MTT-S* 1979 *International Microwave Symposium digest,* 1979 pp 249–252. This resonator acts as a short circuit which terminates the slot for signals whose frequency is within its resonant range. With the diode in the off state, the resonant frequency of the structure is much higher than the operating band of the phase shifter with the result that the insertion loss of the diodes in the off state does not affect the propagation characteristics of the phase shifter. Because of this resonant structure which is used in order to reduce the adverse affects of the diode insertion loss in the off state, the phase shifter 10' has a relatively narrow operating bandwidth which is limited by the width of the resonant frequency band for the microstrip resonators when the diodes are in the on state. The microstrip resonator phase shifter 10' may be designed for narrow band operation in the frequency range up to about 100 GHz at the present time.

What is claimed is:

1. A millimeter wave reflection type phase shifter having first and second ports and operable over a given design frequency band comprising:

a rectangular waveguide network including a leg section and first, second, third and fourth arm sections, said first and second arm sections connected to a first end of said leg section and together with said leg section comprising a first symmetric Y-junction with the free end of said first arm section being said first port of said device and the free end of said second arm section being said second port of said device, said third and fourth arm sections connected to a second end of said leg section and together with said leg section comprising a second symmetric Y-junction, said leg section and said arm sections having substantially planar top and bottom walls and having lateral walls extending between said top and bottom walls;

a fin-line substrate having first and second opposed major surfaces disposed in said waveguide network with said major surfaces parallel to and spaced from said top and bottom walls and forming a septum extending laterally across said leg section and at least a portion of each of said arm sections;

a conductive layer disposed on said first major surface of said substrate and leaving a central non-conductive slot therein, said slot extending along said leg section and portions of said first through fourth arm sections, said conductive layer being RF coupled to said lateral walls at least in said operating frequency band;

a conductor disposed in the vicinity of said substrate extending parallel to and located either one of above or below said slot in said leg section;

means for providing a short across said slot within said third arm section and within said fourth arm section to thereby provide the phase shift between said first and second ports.

2. The device recited in claim 1 wherein:

said slot has a substantially uniform width within said leg section and said third and fourth arm sections and at least part way into said first and second arm sections.

3. The device recited in claim 1 wherein said means for providing a short comprises:

means for switching extending across said slot within said third arm section and within said fourth arm section and responsive to a control signal for switching between a condition in which said means for switching imposes an RF short circuit across said slot and a condition in which said means for switching has substantially no effect on the RF impedance of said slot, said switching means positioned a selected distance from said second Y-junction of said third and fourth arm sections to provide a signal transmitted from said first port to said second port with a desired phase shift.

4. The device recited in claim 3 wherein said means for switching includes a plurality of switches disposed in each of said third and fourth arm sections at distances from each other to provide to said transmitted signal a plurality of selectable phase shifts.

5. The device recited in claim 3 wherein said means for switching comprising PIN diodes.

6. The device recited in claim 5 wherein the electrodes of said diodes are connected to said conductive layer at opposite sides of said slot.

7. The device recited in claim 5 wherein said means for switching further comprises conductive members disposed on said second major surface of said substrate and configured to form a microstrip resonator which is resonant outside said operating frequency band when said diodes are biased in a first state and within said operating frequency band when said diodes are biased in a second state.

8. The device recited in claim 1 wherein within said third and fourth arm sections, said slot has a substantially constant impedance.

9. The device recited in claim 1 wherein said conductor extending parallel to said slot is a wire disposed above said substrate whose ends are connected to said conductive layer.

10. The device recited in claim 1 wherein said conductor extending parallel to said slot is a conductive strip disposed on said second surface of said substrate.

11. The device recited in claim 1 wherein said means for providing a short comprises non-controllable means disposed in said third and fourth arms for RF shorting said slots therein.

* * * * *